United States Patent [19]

Ence et al.

[11] 4,330,040

[45] May 18, 1982

[54] FIRE PREVENTION AND COOLING SYSTEM

[76] Inventors: Gerald R. Ence, 1227 Woodrow St., Oildale, Calif. 93308; Robert D. Ence, 255 S. Main St., Aurora, Utah 84620

[21] Appl. No.: 149,014

[22] Filed: May 12, 1980

Related U.S. Application Data

[63] Continuation-in-part of Ser. No. 74,913, Mar. 12, 1979, abandoned.

[51] Int. Cl.[3] ..... A62C 35/00

[52] U.S. Cl. ..... 169/13; 169/16; 239/209; 248/220.1; 248/237

[58] Field of Search ..... 169/5, 13, 16, 17, 45; 248/74 R, 65, 71, 220.1, 237; 239/208, 209, 450, 558, 567

[56] References Cited

U.S. PATENT DOCUMENTS

| | | | |
|---|---|---|---|
| 128,534 | 7/1872 | Carl | 169/16 |
| 558,653 | 4/1896 | Miller | 169/17 |
| 647,875 | 4/1900 | Piepenbrink | 169/16 |
| 1,208,349 | 12/1916 | Moody | 169/16 |
| 1,620,142 | 3/1927 | Thompson | 169/16 X |
| 1,831,880 | 11/1931 | Pierce | 169/16 |
| 1,936,732 | 11/1933 | Renard | 169/16 X |
| 2,141,032 | 12/1938 | Cordell | 248/74 R X |
| 2,566,833 | 9/1951 | Healy | 239/450 |
| 3,179,181 | 4/1965 | Banzato | 169/16 X |
| 3,583,490 | 6/1971 | McFadden | 169/16 X |

*Primary Examiner*—Gil Weidenfeld
*Assistant Examiner*—Fred A. Silverberg
*Attorney, Agent, or Firm*—Romney, Golant, Disner & Ashen

[57] ABSTRACT

A fire prevention and cooling system for wetting a structure, including a main supply tube and a main dispensing tube. The dispensing tube is U-shaped and is connected to the supply tube via a series of feed lines. The system includes elements to acquire water from alternative sources such as a pool or a tub and secondary tubes for wetting side walls.

5 Claims, 11 Drawing Figures

Fig. 4
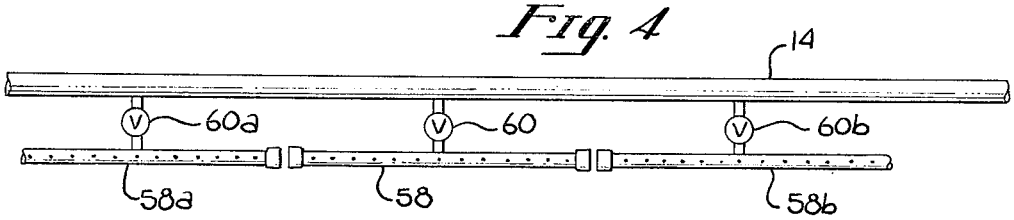
Fig. 5
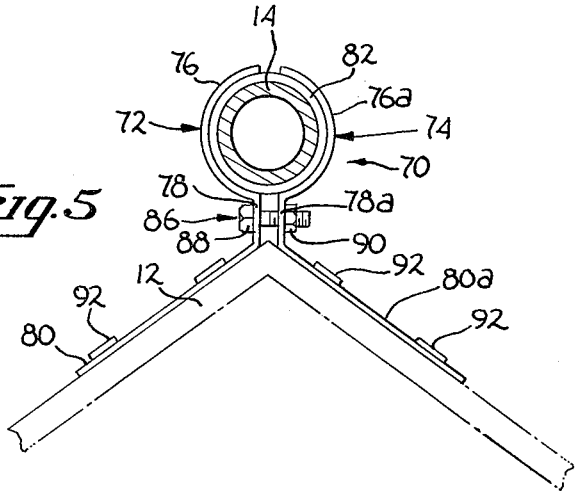
Fig. 6
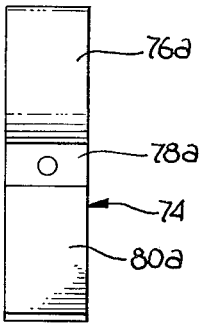
Fig. 7
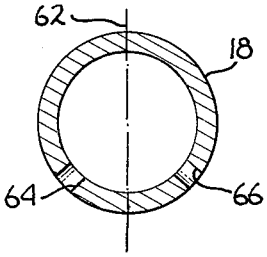
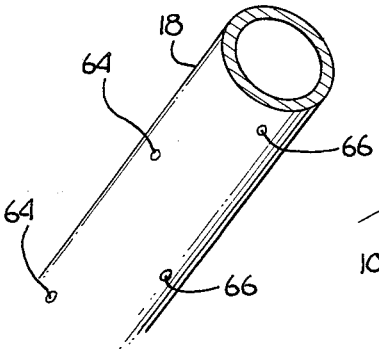
Fig. 8
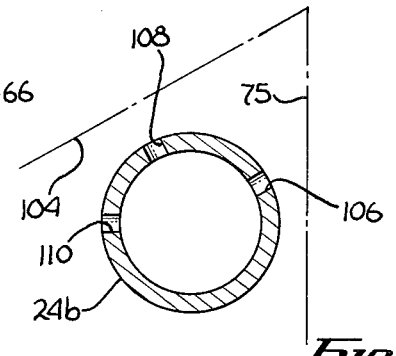
Fig. 9
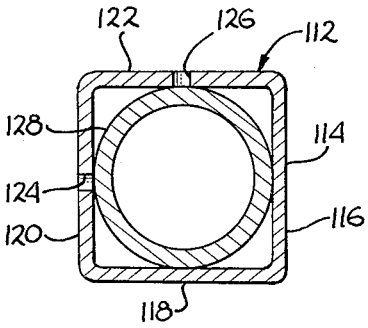
Fig. 11
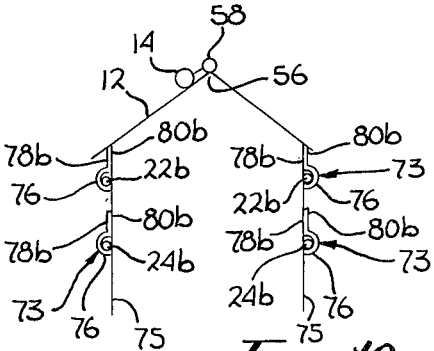
Fig. 10

FIRE PREVENTION AND COOLING SYSTEM

This is a continuation-in-part of application Ser. No. 074,913, filed Mar. 12, 1979 now abandoned.

BACKGROUND OF THE INVENTION

1. Field of the Invention

The present invention relates to a fire prevention and cooling system, and more particularly, to a system connected to a water source for directing water along the upper portions of a structure to be protected from fire, the system being efficient, relatively inexpensive, reliable and effective.

2. Description of the Prior Art

Fire is an ever present hazard, especially in certain areas of the Western United States, where rainfall is slight, and at certain times of year, nonexistent. The Southern California area is plagued with fires on an annual basis. Wherever the fire strikes there is great loss, especially if residential areas are within the fire's path. In such cases there is substantial property loss and psychological disruption. Traditional firefighting techniques are only partially effective since the residential homes involved may be spread over a large area and include substantial dry foilage. In addition, the terrain is often hilly and subjected to difficult fire fighting weather conditions, such as high winds and heat.

SUMMARY OF THE INVENTION

The present invention solves the problems that now exist by providing a system primarily for fire prevention whereby water may be transferred from a source to a potentially combustible part of a structure such as a roof or sidewalls, the system comprising a supply conduit communicating water from said source to and along the structure's part; a dispensing tube having a plurality of openings, the tube being connected to the supply conduit and positioned above the structural part; and a series of feed lines connected between the supply conduit and said dispensing tube for permitting water to flow to said dispensing tube at relatively constant pressure from one end of said dispensing tube to the other.

It is an aim of the present invention to provide a fire prevention and cooling system which is reliable, effective and yet relatively inexpensive.

Another aspect of the present invention is to provide a fire prevention and cooling system for effectively soaking the more vulnerable portions of a structure prior to the arrival of a spreading fire.

Another object of the invention is to provide a system which will cool a structure without the use of airconditioning or as a supplement to airconditioning thereby saving airconditioning costs.

Still another aspect of the present invention is to provide a fire prevention system which functions on small amounts of water pressure, such as might be expected during a wide spread fire.

The foregoing objects, advantages, features and results of the present invention together with various other objects, advantages, features and results thereof which will be evident to those skilled in the art in light of this disclosure may be achieved with the exemplary embodiments of the invention described in detail hereinafter and illustrated in the accompanying drawings.

BRIEF DESCRIPTION OF THE DRAWINGS

FIG. 4 is a partially diagrammatic plan view of a portion of the system illustrating a supply conduit, corresponding dispensing tubes and corresponding valves therebetween.

FIG. 5 is an enlarged elevational, sectional view of the supply conduit and a clamp for supporting the conduit to a mounting, such as the roof of a house.

FIG. 6 is a side elevational view of the clamp of FIG. 3.

FIG. 7 is an enlarged cross-sectional view of the dispensing tube shown in FIG. 3.

FIG. 8 is a perspective view of a portion of the dispensing tube illustrating the openings formed in the tube.

FIG. 9 is an enlarged cross-sectional view of a modified dispensing tube which might be used under the eves of a house.

FIG. 10 is a diagrammatic elevational view showing a modified disposition of a supply conduit and dispensing tubes on the roof of a structure and under its eves.

FIG. 11 is a cross-sectional view of a jig for manufacturing the dispensing tube and a tube to be formed.

DESCRIPTION OF THE PREFERRED EMBODIMENTS

Figure 1:
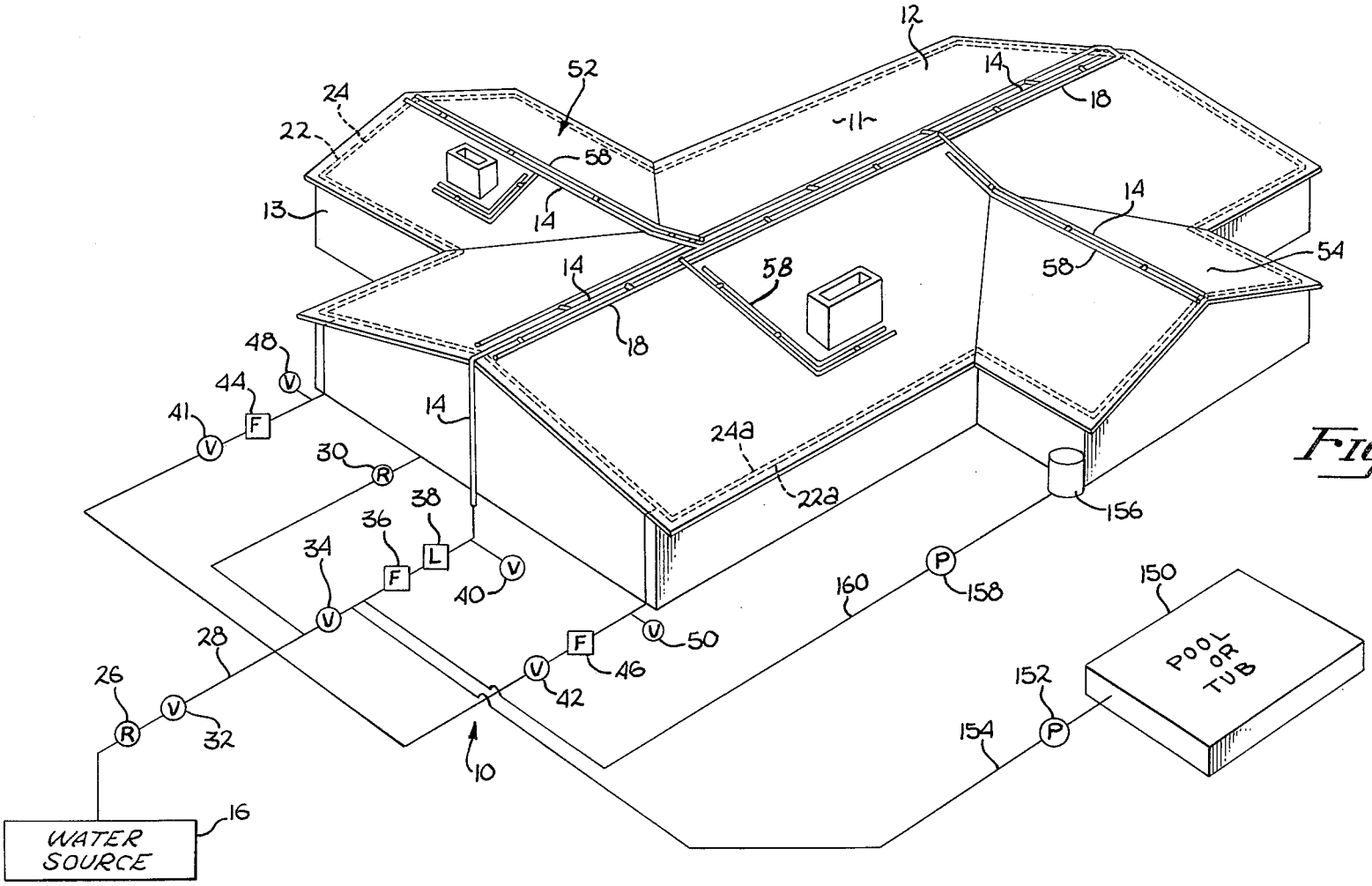
FIG. 1 is a partially perspective, partially diagrammatic view of the fire prevention and cooling system for a residential structure.

While the present invention is susceptible of various modifications and alternative constructions, embodiments are shown in the drawings and will herein be described in detail. It should be understood however that it is not the intention to limit the invention to the particular forms disclosed; but, on the contrary, the intention is to cover all modifications, equivalences and alternative constructions falling within the spirit and scope of the invention as expressed in the appended claims.

Figure 3:
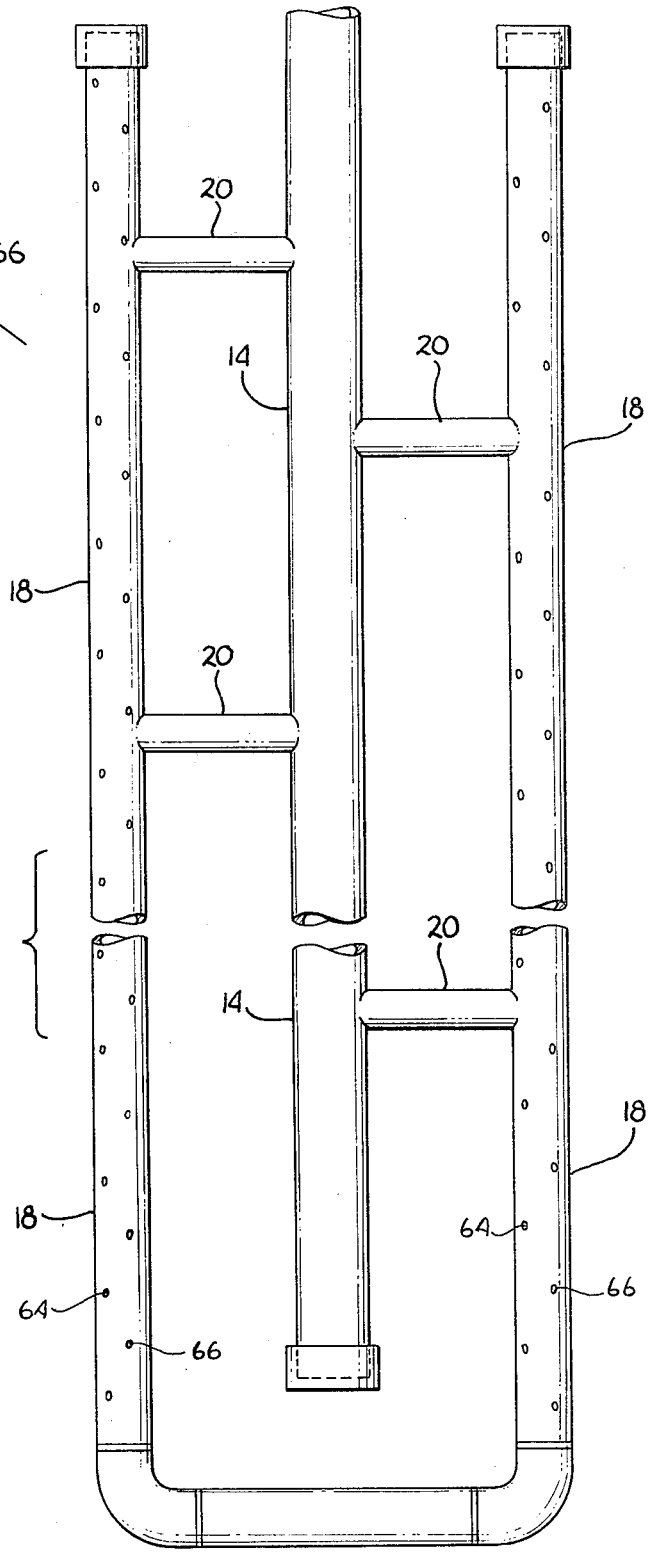
FIG. 3 is a partial plan view of a portion of the system illustrating a supply conduit, a corresponding dispensing tube and corresponding feed lines therebetween.

Referring now to FIGS. 1 and 3, the system 10 is shown as might be applied to a residential structure such as a house 12. The system comprises supply conduits or tubes 14 which are connected to a water source 16 for transferring or communicating water from the source to dispensing tubes 18 through feed lines 20. The water may be directed to the roof 11 of the house, the region under the eves or, preferably, to both. The purpose of the system is to soak the roof and the walls of the house to prevent a fire. For wetting the walls (such as the wall 13) and the exposed undersides of the roof, a similar supply conduit 22 and dispensing tube 24 arrangement may be provided under the eves of the roof.

As mentioned above, the fire hazard is quite acute in the Southern California region because of the small amount of rainfall, long periods of time without rainfall and the growth of combustible brush. When a fire starts, it usually spreads in residential areas by two methods: first, airborne matter is blown from the fire to combustible material, such as a wood or composition roof of a house; and, second, intense heat in a house created by the fire often causes the house to explode before the fire actually reaches the house. In Southern California, for example, at certain times of the year, strong winds frequently blow very warm air from the desert over the coastal residential areas; often this happens after a long dry spell. The combination causes ideal fire conditions. Thus, if a fire starts, warm winds are available to spread it very quickly. In addition, the fire itself causes wind velicities which could be as great as sixty-five miles per hour. The other factor, intense heat and explosion, occurs when a house in the vicinity of a fire, but itself not yet on fire, does not have sufficient ventilation to remove the intensely heated air building up within. This results in an explosion and rapid combustion of the house.

In order to understand the effectiveness of the subject system it is necessary to know that the types of fires described move extremely quickly; a particular house may be exposed to a fire for only a few minutes while generally the house occupants have from between one to four hours notice of fire danger. Thus, the inventors have discerned that if the house can be suitably protected for those few minutes, there is a good likelihood that the house will not catch fire. It is also important to note that an unprotected human being cannot ordinarily remain with his house at the time the fire passes due to the intense heat and lack of oxygen. In addition, fires of the type described are often accompanied by severe water usage and sometimes loss of all water pressure.

It is the intention here to describe a system which can soak the more exposed portions of a structure, such as the roof and walls prior to the fire reaching the structure. It has been found that an average size house such as that shown in FIG. 1, can be soaked in less than 20 minutes with a relatively small amount of water and even under relatively low pressure conditions. If the house is soaked it will not catch fire as readily and the soaking keeps the internal temperature down.

Returning once again to FIG. 1, the usual residential structure is connected to a water source 16 which may be an underground city water line, a hillside water tank, or a well. Such a water source generally has pressure in a range from 500 to 1000 psi. Since this is too great a pressure for the use within the residential structure, a pressure reducer or restricter 26 is placed in the water "line" 28 leading from the source to the structure. Thus, downstream of the pressure reducer, the pressure is within the range of 100 to 150 psi. Before entering the house, however, another pressure reducer or restricter 30 is usually placed in the line so that the pressure actually existing at the water faucets in the house is between 48 and 60 psi. The usual water line also includes a valve 32, commonly referred to as a back flow valve, which in reality is a one way valve allowing water to travel from the water source 16 to the structure 12, but not in the opposite direction. The inventive system which will be described in more detail hereinbelow is connected to the usually existing water line so that it can benefit from existing equipment and minimize expense.

As shown diagrammatically in FIG. 1, the supply conduit 14 is connected to the water line 28 at a point downstream or to the house side of the backflow valve 32. Thus, the backflow valve will function to protect the main water source not only from possible house related contamination, but also contamination from the fire prevention system. Moving in a downstream direction, the system may include an on-off valve 34, which acts as the master control for the system. Normally, the valve 34 is closed. However, for testing purposes or in the event of a fire, the valve is moved to its open position so that water will flow through the supply conduit 14. Downstream of the master control valve is a filter 36, a liquid solution feeder 38 and a drain valve 40. Normally, the drain valve is kept open to protect the system.

In a like manner, each side of the house may have an under-eves system such as described earlier with the supply conduit 22 and the dispensing tube 24. As with the roof top system, the under-eves system is connected to the main water line 28 downstream of the backflow valve 32. The under-eves system is divided into two parts, one for each side of the house, for better control. The system on the left has a master control valve 41 while the system on the right has a master control valve 42. Each part of the system includes a filter 44, 46 and a drain valve 48, 50. (For purposes of simplicity, the supply conduit on the right side of the house is designated 22*a*, while the dispensing tube is designated 24*a*.)

The master control valves 34, 41 and 42 may be made of brass, bronze or plastic and are commonly available under the commercial name, "gate valves". The drain valves 40, 48 and 50 may be standard water faucet valves of any suitable and commercially available material. The filter may be of any one of a number of commercially available filters such as that manufactured by the Johns-Manville Co., Filtration & Industrial Minerals Division, Denver, Colo. and sold under the tradename "Johns-Manville Water Filter System." The liquid solution feeder may be used for introducing fire retardant chemicals. Any suitable chemical solution pump system, such as that marketed by W. W. Grainger Inc. of Los Angeles, Model Number 1P 886, may be used. It may be appreciated that the use of commercially available elements for the system enhances its reliability while minimizing costs.

In an additional effort to minimize costs, the supply conduits and dispensing tubes may be of standard copper, galvanized, ABS or PVC (rigid polyvinyl chloride) material. Depending upon the size of the structure, the water pressure in the area and the number of branch arms caused by the diverging structure, such as portions 52 and 54, FIG. 1, the supply line may vary in inner diameter from about one-half inch to a little over four inches, while the dispensing tube may be a somewhat smaller dimension ranging from three-eights of an inch to one inch. The wall thicknesses may vary from 0.045 to 0.138 inches. A sufficiently strong PVC tube is readily commercially available. Preferrably schedule M "sweat copper" copper tubing is used since this will last as long as the other tubing used in a structure to be protected and is more reliable. For copper tubing the supply tube is between 0.75 inches to 2 inches while the dispensing tube is 0.50 inches.

Figure 2:
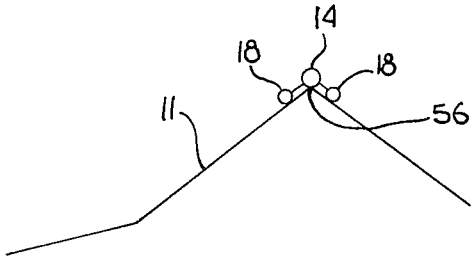
FIG. 2 is a diagrammatic elevational view showing the disposition of a supply conduit and dispensing tubes on the roof of a structure.

As mentioned earlier, the placement of the system allows for complete coverage of the structure to be wetted, such as the roof 11 of the structure shown in FIG. 1. Referring now to FIGS. 2 and 3, the parallel alignment between the supply conduit 14 and the dispensing tube 18 is shown. The dispensing tube comprises a U-shaped tube surrounding the supply tube. The dispensing tube is positioned so that one portion overlies and wets one side of the roof while the other portion overlies and wets the other side. The supply tube itself is placed at the peak or apex 56 of the roof. It has been found that the best results occur when the dispensing tube is placed between one-half and two inches above the roof. As will be explained below, spacing of the dispensing tube is accomplished by a special clamp. The dispensing tubes are disposed so that one line of openings provides a stream of water generally perpendicular to the roof whereas another line of openings would allow a stream of water to be dispensed generally parallel to the roofline. However, it should be noted that for a flat roof the tube is turned upsidedown so that the openings are facing upwardly.

For the most even water distribution it has been found that the feed lines connecting the dispensing tube with the supply tube should be positioned about 10 feet apart. The opposite facing feed lines are staggered as shown in FIG. 3 so the water pressure remains relatively constant from one end of the dispensing tube to the other.

In an alternate embodiment shown in FIG. 4 each supply tube is connected to a series of dispensing tubes 58, 58*a* and 58*b* through a series of control valves 60, 60*a* and 60*b*. In this embodiment the dispensing tubes are positioned at the peak or apex of the roof. The best results occur when the dispensing tube is placed between one-half and two inches above the peak. The dispensing tubes are disposed so that the openings are facing in a downward direction as shown in FIG. 7. More exactly, for the type of roof depicted in FIGS. 1 and 2, the dispensing tube is placed so that the paths formed by the plurality of openings in the tube are offset by 45° from a vertical reference line designated 62 in FIG. 7.

This single side dispensing tube embodiment is especially useful in conjunction with the dual side dispensing tube 18 shown above. FIG. 1 illustrates the manner in which the dual side dispensing tube 18 runs along the length of the rooftop while the single side dispensing tube 58 is used for branches such as branch 52 taken from the main supply tube. These branches can cover the roof along wings of the structure as well as the area around chimneys. For best control, it has been found that the single side dispensing tubes should be separate segments approximately 20 feet in length. For example, in FIG. 4, three such segments are shown, 58, 58*a* and 58*b*. Each of the segments is supplied from a common supply line 14, though each is fed through an individual or corresponding valve such as the valves 60, 60*a* and 60*b*, respectively. By dividing the dispensing tube into 20 foot segments, each controlled by its own valve, equalization among the segments can be achieved and the usual uneven distribution, caused by a greater pressure closer to the fluid source, can be alleviated. This is especially the case where several branches may be used such as is shown in FIG. 1.

Referring now to FIGS. 7 and 8, the dispensing tube 18 is shown in more detail and includes spaced openings which are formed longitudinally along the tube in two parallel paths, such as the openings 64 and 66. As can be seen clearly from FIG. 7, these paths are spaced from one another by 90°. The size of the holes has also been found to be important. In order to get the desired spray characteristics using a minimum of water and keeping pressure to a minimum, it has been found that hole sizes between 0.063 inches and approximately 0.080 inches give the best results with a size of 0.069 inches being preferrable, assuming a normal pressure of 60 psi. Larger openings could be used however when pressure can be assured. The hole size to be used varies depending upon the shape and extent of the area to be covered.

Referring now to FIGS. 5 and 6, there is illustrated the clamp 70 used to hold the supply conduit 14, FIG. 1, and 14, FIG. 4, at a predetermined position above the roof 12. The clamp is formed by two identical elements 72 and 74 which are disposed in positions opposite to each other so that one looks like the mirrored image of the other. Each element includes three integral sections, an outer semicylindrical section 76, 76*a*, a middle section 78, 78*a* and an outer leg section 80, 80*a*. The two semicylindrical sections 76, 76*a* form a cradle for the supply conduit 14. Positioned between the supply conduit and the clamps is a bushing 82 made of a resilient material, such as hard rubber, for providing some cushioning of the tube.

The degree of tightness with which the clamp elements fit about the conduit is determined by a connector 86 comprising a bolt 88 and a nut 90 combination which are fitted to the middle sections. By tightening the nut the elements come together. The leg sections 80, 80*a* are disposed at an oblique angle to the middle section and are flexible to allow bending to follow the configuration of the roof 12. A fastener, such as nails 92, molly bolts or wood screws may then be driven through the lower sections and into the roof for securing the clamp to the roof. It should be remembered that the clamp will be subjected to a tensioning force when the system is activated due to water pressure. The higher the pressure, the greater the force on the clamps. The clamp elements are made of a strip of material such as steel, or plastic, one-eighth inch thick and from one-half to two inches wide.

Referring briefly to FIG. 10, the clamp elements may be used singlely to support either the supply tube or the dispensing tube. By way of example, a clamp element 73 may have its leg section 80*b* aligned with its middle section 78*b*. The leg section is affixed by a suitable fastener to a wall 75 of the structure so that the semicylindrical section 76 entraps the supply pipe 22*b* between itself and the wall. As shown, the identical arrangement can be used for the dispensing tube 24*b*.

Referring now to FIG. 9, the dispensing tube 24*b* is shown in greater detail. As mentioned the tube is adjacent to the wall 75 and under an eve 104 of a structure, such as the residential home shown in FIG. 1. Like the tube shown in FIG. 7, the tube in FIG. 9 includes two rows of openings, one represented by the opening 106 and the other represented by the opening 108, which is disposed at 90° from the opening 106. In addition, a third line of openings, represented by the opening 110, is positioned approximately 60° from the line of the opening 108. When the dispensing tube is positioned as shown in FIG. 9, the water spray will not only cover the wall 75 and the eve immediately adjacent the wall, but also that portion of an extended eve which may lie at a distance from the wall.

Exemplifying the simplicity of the system and the low cost manner in which it can be made, reference is made to FIG. 10 which illustrates a jig 112 for making the dispensing tube. The jig may be formed of square cross-sectioned tubular steel 118 having four longitudinally extending sides. Along two adjacent sides, such as the sides 120 and 122 are a series of openings represented by the openings 124 and 126. Positioned within the jig is a standard tube, such as the tube 128 in which the openings are to be formed. The openings in the tube are formed by passing a drill through the openings 124 and 126 and into the tube within.

Referring now to FIG. 1 once more, there is illustrated a secondary or backup system for providing water to the system. Quite often a residential property may have a swimming pool or hot tub 150 adjacent the structure. With a pump 152 and a conduit 154, the secondary system could be installed in the supply line to the supply conduit 14. As shown, the system is connected between the control valve 34 and the filter 36. An alternative auxiliary system includes a common fifty-five gallon drum 156, a pump 158 and a conduit 160. The fifty-five gallon drum may be placed at the discharge of a gutter system so as to reuse the water runoff from what has already been sprayed onto the roof.

The pump 152 or 158 may be open air or submersible, such as those offered by the Teel Co. These pumps are hermetically sealed, centrifugal pumps which are commonly used in fountains, vaporizers and coolant circulation systems. As was mentioned, since it does not take very long to soak a roof, and since a fire is a potential threat only for a few minutes, a relatively small amount of water is sufficient to save a structure. Thus, even a hot tub or a recirculation system is sufficient.

Once the system is installed, operation is extremely simple. For example, where the roof type system only is available, the system is activated by closing the drain valve 40 and opening the master control valve 34. If sufficient pressure exists in the main water line, then the system will function in its intended manner. If sufficient pressure does not exist, then one of the backup systems may be used, such as the pool, by activating the pump 152. The pressure created by the pump will be a direct function of the pump's capacity. In a like manner, the pump 158 may be activated to transfer the water from the barrel 156 to the main supply line. The latter system may be appropriate when the main source of water has been operating for a time. Even though pressure may drop, water has already been sprayed on to the roof and has been collected in the barrel.

If the system also includes the under-eves arrangement, as shown in FIG. 1, then drain valves 48 and 50 are closed and control valves 41 and 42 are opened.

What is claimed is:

1. A liquid dispensing system primarily for fire prevention whereby water may be transferred from a source to potentially combustible parts of a structure, such as a roof or side walls, the system comprising:

a supply conduit communicating water from said source to a dispensing tube, said supply conduit including a filter and having a first portion thereof disposed above the peak of a roof of such structure and at least a second portion disposed perpendicular to said first portion and extending away therefrom, said second portion including an arm extending perpendicularly therefrom for partially going around an obstacle;

a first dispensing tube having a plurality of openings, said tube having a generally U-shape where said U-shape has oppositely disposed arms and a connecting base portions, wherein water in any part of one arm of the U can communicate with water in any part of the other arm of the U by way of the base and wherein the arms of said U are disposed parallel to but at a lower elevation from the first portion of the supply conduit;

a second dispensing tube having a plurality of openings, said second tube extending parallel to the second portion of said supply conduit;

a first series of feed lines attached to said supply conduit and said first dispensing tube for permitting water to flow from said supply conduit to said first dispensing tube at relatively constant pressure from one arm of said first dispensing tube to the other arm, said first series of feed lines being staggered so that feed lines extending to one arm of said dispensing tube are out of alignment with feed lines extending to the other arm of said first dispensing tube; and a second series of feed lines attached to said second portion of said supply conduit and said second dispensing tube for permitting water to flow from said second portion of said supply conduit to said second dispensing tube at relatively constant pressure from one end of said second dispensing tube to the other wherein blockages of certain portions of said first dispensing tube does not deprive downstream sections of said dispensing tube of water.

2. A system is claimed in claim 1 including:

a third portion of said supply conduit disposed perpendicular to said first portion and extending away therefrom for extending along a wing of said structure;

a third dispensing tube having a plurality of openings, said tube extending parallel to the third portion of said supply conduit; and a third series of feed lines attached to said third portion of said supply conduit and said third dispensing tube for permitting water to flow from said third portion of said supply conduit to said third dispensing tube at relatively constant pressure from one end of said third dispensing tube to the other.

3. A system is claimed in claim 2 including:

a first under-eves system including a first eves control valve, a first eves filter, a first eves supply conduit and a first eves dispensing tube, said first eves supply conduit being downstream from the control valve and the first eves filter and upstream from said first eves dispensing tube; and a second under-eves system including a second eves control valve, a second eves filter, a second eves supply conduit and a second eves dispensing tube, said second eves supply conduit being downstream from said second eves control valve and said second mentioned filter and upstream from said second eves dispensing tube.

4. A system is claimed in claim 1 wherein said dispensing tube is ½ to 2 inches above the roof.

5. A system is claimed in claim 1 including:

a submersible pump; and means communicating said pump to said supply conduit whereby a secondary fluid source selected from the set consisting of a pool, a tub and a barrel may be used.

* * * * *